US007527243B2

(12) United States Patent
Blasek

(10) Patent No.: US 7,527,243 B2
(45) Date of Patent: May 5, 2009

(54) PLATFORM LIFTING MECHANISM PROVIDED WITH A DRIVING PULLEY AND CORRESPONDING DRIVING SYSTEM

(75) Inventor: Frank Blasek, Bergisch Gladbach (DE)

(73) Assignee: Greifzug Hebezeugbau GmbH, Bergisch Gladbach (DE)

( * ) Notice: Subject to any disclaimer, the term of this patent is extended or adjusted under 35 U.S.C. 154(b) by 439 days.

(21) Appl. No.: 10/591,208

(22) PCT Filed: Feb. 17, 2005

(86) PCT No.: PCT/EP2005/001619

§ 371 (c)(1),
(2), (4) Date: Aug. 31, 2006

(87) PCT Pub. No.: WO2005/085119

PCT Pub. Date: Sep. 15, 2005

(65) Prior Publication Data

US 2007/0272490 A1 Nov. 29, 2007

(30) Foreign Application Priority Data

Mar. 3, 2004 (DE) ..... 10 2004 010 308

(51) Int. Cl.
*B66D 1/00* (2006.01)

(52) U.S. Cl. ..... 254/333; 254/278; 254/336; 254/383; 254/371

(58) Field of Classification Search ..... 254/278, 254/333, 336, 383, 371
See application file for complete search history.

(56) References Cited

U.S. PATENT DOCUMENTS 4,069,921 A * 1/1978 Raugulis et al. ..... 254/337
4,205,871 A * 6/1980 Manabe et al. ..... 254/333

(Continued)

FOREIGN PATENT DOCUMENTS

DE 35 09 920 11/2000

(Continued)

OTHER PUBLICATIONS

English Translation of International Preliminary Report on Patentability corresponding to International Application No. PCT/EP2005/001619.

(Continued)

*Primary Examiner*—Emmanuel M Marcelo
(74) *Attorney, Agent, or Firm*—Fay Sharpe LLP

(57) ABSTRACT

The invention relates to a traction sheave hoist for a platform operated by at least two ropes 5, having a traction sheave 13 that can be driven by a motor, at least a first rope groove and a second rope groove 17 being formed around the traction sheave circumference, and a first hold-down system for the first rope groove and a second hold-down system 20 for the second rope groove 17 with which the ropes wrapping around the traction sheave 13 are pressed into the corresponding rope grooves 17 during operation. In order to be able to ensure the horizontal alignment of the platform at all times, an adjustment device 30 is assigned to at least one of the hold-down systems 20 with which the position or engagement depth of the rope 5 in the rope groove 17 achieved with the corresponding hold-down system 20 can be controllably varied.

23 Claims, 5 Drawing Sheets

U.S. PATENT DOCUMENTS

| | | | | |
|---|---|---|---|---|
| 4,415,140 | A * | 11/1983 | Deering | 254/371 |
| 4,706,940 | A | 11/1987 | Harig | |
| 4,842,101 | A * | 6/1989 | Lamb | 187/266 |
| 4,846,446 | A * | 7/1989 | Peppel et al. | 254/277 |
| 5,186,283 | A * | 2/1993 | Salmon | 187/254 |
| 5,202,539 | A * | 4/1993 | Lamb | 187/254 |
| 5,792,294 | A * | 8/1998 | Randazzo et al. | 156/94 |
| 5,988,596 | A * | 11/1999 | Mitchell et al. | 254/271 |
| 6,318,506 | B1 * | 11/2001 | Marte et al. | 187/373 |
| 6,796,548 | B2 * | 9/2004 | Nagata et al. | 254/278 |
| 7,104,492 | B1 * | 9/2006 | Massell et al. | 242/397 |

FOREIGN PATENT DOCUMENTS

| | | |
|---|---|---|
| DE | 200 07 855 U1 | 11/2000 |
| FR | 2 146 654 | 3/1972 |

OTHER PUBLICATIONS

International Search Report corresponding to International Application No. PCT/EP2005/001619.

* cited by examiner

V
20
5
21
24
23
22
25
28
27
21
17
72
71
73
26
29
26A
29A
90
91
92
31
34
33
30
93
32
13'
13
11'

PLATFORM LIFTING MECHANISM PROVIDED WITH A DRIVING PULLEY AND CORRESPONDING DRIVING SYSTEM

The invention relates to a traction sheave lifting hoist for a platform displaceable by means of at least two ropes, having a traction sheave that can be driven by a motor, at least a first rope groove and a second rope groove being formed around the traction sheave circumference, and a first hold-down system (pressure system) for the first rope groove and a second hold-down system (pressure system) for the second rope groove with which the ropes wrapping around the traction sheave are pressed into the corresponding rope grooves during operation. The invention further relates to a service lift for facades of building and similar structures with a moving platform operated by means of at least two ropes and a traction sheave hoist with a traction sheave driven by a motor having a rope groove around its circumference for each rope.

In order to be able to carry out repair and cleaning operations on the outer facades, windows, technical installations and glazings of modern high-rise buildings, moving platforms or working platforms are moved along the facade using rope hoist devices. As persons are transported with the platform, safety regulations demand that in addition to a load rope with which the weight of the platform can be supported, a further rope, e.g. a safety or arrester rope, is provided that prevents the working platform from falling in the event of a failure of the load rope or the rope hoist device. Longer working platforms generally require at least four load ropes, or two load ropes and two safety ropes. In the simplest embodiment of the working platform, a continuously running motor-operated hoist with a traction sheave is attached to each end of the working platform, as described in DE 35 09 920 C2 or DE 200 07 855 U1 of the applicant. The traction sheaves of the continuously running hoists have a rope groove around their circumference into which a rope is pressed by a hold-down system. The hold-down system has two hold-down rollers mounted pivotably on a roller support and the roller support is pivotably mounted on a lever preloaded in hold-down direction under spring pressure.

The problem with service lifts with longer platforms is in particular to ensure at all times that the working platform is aligned more or less exactly horizontally. In addition efforts are being made to move the platform by means of a single motor preferably mounted on the roof. Trials have already been conducted in this respect with the load ropes being driven by a single common traction sheave. This then has two rope grooves alongside one another, with the hold-down systems for the two load ropes being rigidly connected to one another in order to achieve the same hold-down forces on both ropes. Furthermore, with this traction sheave hoist it is necessary for the two rope grooves to be manufactured with the highest accuracy relative to one another in order to avoid different effective winding diameters being obtained for manufacturing reasons. Furthermore this construction requires the use of exclusively ropes from the same manufacturer and from the same manufacturing batch for the load ropes, as otherwise variations in the diameter of the load ropes could occur that could lead to non-uniform lifting of the two ropes and hence to inclinations of the platform. If damage occurs to one of the ropes, the whole rope system has to be replaced.

The object of the invention is to create a traction sheave hoist for a platform and a service lift with a corresponding traction sheave hoist that has a compact design, can be produced with reasonable manufacturing costs and by design prevents inclinations of the platform.

This and further objects are achieved with respect to the traction sheave hoist with the invention according to Claim 1 and with respect to the service lift with the invention according to Claim 18. Advantageous embodiments are indicated in the subclaims.

The invention provides that with the traction sheave hoist that is also to be used in the service lifts for the inner and outer facades of buildings, an adjustment device is assigned to at least one of the hold-down systems with which the position or engagement depth of the rope in the rope groove achieved with the respective hold-down system can be controllably varied. According to the invention, the adjustment device is consequently to be used to influence the hold-down system in response to control commands so that whenever an inclination of the platform occurs or could occur, this effect can be countered by actuating the adjustment device. Changing the engagement depth of the rope in the rope groove changes the radial distance between the rope and the rotation axis of the traction sheave, so that the lift achieved at each rotation of the traction sheave is also changed. With the active influencing of the engagement depth or the position of the rope in the rope groove provided for by the invention, it is at the same time no longer necessary to manufacture the multiple rope grooves on the traction sheave with the greatest possible accuracy, as minor deviations in the rope groove or in the rope can now be compensated by actuating the adjustment device and changing the current position of the hold-down system.

In a preferred embodiment, an adjustment device is assigned to each hold-down system so that the adjustment devices can be preferably actuated in such a way that with each adjustment device, the position or engagement depth of the corresponding rope in its rope groove can be varied or adjusted in relation to the position or engagement depth of all the other ropes in their rope grooves. Provision of several adjustment devices allows a significantly more variable compensation possibility for different engagement depths in the rope grooves and hence different effective winding diameters and lengths at the traction sheave. Particularly the embodiment with an adjustment device assigned to each hold-down system permits furthermore in the preferred embodiment the single traction sheave to be provided with a total of four rope grooves around its outer circumference, so that then preferably all four rope grooves are each provided to take one carrying rope. For this embodiment, the hoisting movements for all the ropes necessary for the lifting and lowering of the platform can consequently be performed with a single extremely compact traction sheave.

Furthermore, the adjustment devices should preferably each be separately controllable. The adjustment device can comprise different mechanical adjustment mechanisms for adjusting the position of the hold-down system. In a preferred embodiment, each adjustment device comprises a lifting magnet. A hoist system can alternatively be provided with a rotating spindle, a hydraulic or pneumatic adjustment cylinder or similar mechanisms.

With the preferred embodiment of the traction sheave hoist, the adjustment device is connected to the hold-down system via a connecting device transmitting only tensile forces. The connecting device can consist in particular of a chain. Each hold-down system furthermore preferably comprises, as already known from the generic continuously running hoists, a pivot-mounted lever on the housing of the traction sheave hoist to which a tie rod is linked that presses or preloads the lever against the traction sheave by means of a pressure spring. It is also particularly advantageous if each hold-down system has two hold-down rollers mounted pivotably on a roller support, as described in detail in DE 35 09 920 to which reference is expressly made in this content. A hold-down system of this type offers the particular advantage that in a preferred embodiment, the adjustment device can be arranged in series with the spring and/or in series with the tie rod, so that the adjustment device consequently has a direct influence on the preload applied with the pressure spring and the position of the hold-down system. The actual resulting preload applied by the pressure spring for the rollers of the hold-down system and hence its absolute position can consequently be changed with the adjustment device. It is particularly advantageous if an evaluation and control device assigned to the adjustment devices is provided via which the respective position or hold-down position of each hold-down system can be controllably varied.

Furthermore, the traction sheave hoist is preferably additionally provided with a winding device for each rope, wherein the winding device can preferably be driven with the motor for the traction sheave of the traction sheave hoist. The integration of a winding device for each rope into the housing of the traction sheave hoist leads to a further minimisation of the necessary installation space. In addition the integrated winding device simplifies the positioning of the traction sheave hoist on a roof carriage or crane boom. It is particularly advantageous if the winding device for each rope has a winding drum, with each winding drum being provided with an external gearing, with a drive sprocket mounted on a drive shaft via a slip clutch, each being in mesh with said external gearing. The drive sprocket is preferably formed by a clutch disc with an external gearing. Two clutch discs with external gearing can be arranged in each slip clutch to drive two winding drums. The use of gearings to drive the individual winding drums results in a good transmission of power of the drive energy to the individual winding drums. With the slip clutch installed between each drive gearing and the output shaft it is possible in a comparatively simple manner to ensure that the ropes are wound taut on the rope drum at all times, irrespective of the current winding diameter. It is particularly advantageous to connect the output shaft to a drive shaft for the traction sheave in such a way that a freewheel exists in one direction of rotation and a positive drive in the other direction of rotation. The freewheel between output shaft and drive shaft in one direction of rotation ensures that the winding device is driven only when raising the platform, while it unwinds practically load-free during lowering of the platform. With preference furthermore, one or preferably two controllable braking devices are assigned to the output shaft in order to be able to effect an emergency lowering of the platform even in the event of a failure of the complete electrical system. The braking devices can be controlled in particular mechanically, preferably via a Bowden cable or similar device.

With preference furthermore, a sensor device for detection of slack rope and/or overload is provided for each load rope. In a preferred embodiment the sensor device permits the detection of slack rope and overload at the same time. In the preferred embodiment of such a sensor device, it comprises a sensor arm mounted pivotably about a pivot bearing and a sensing arm mounted pivotably about the pivot bearing on which a sensing roller that is in contact with the corresponding rope during operation is mounted pivotably about a pivot bearing, wherein the sensing arm is preferably connected to the sensor arm via a preloading device such as a preloading spring or roll pin that slews the sensing arm relative to the sensor arm in relation to the contact or roll forces acting on the sensing rollers. The overload and slack rope detection can be effected in a comparatively simple manner by the combination of a sensing arm and a sensor arm that are connected together. With preference furthermore, a sensing arm with sensing roller is provided for each load rope or for each rope, wherein the sensor arms of all the sensor devices are rigidly connected to one another. The connection of all the sensor arms ensures that in the event of an overload of the system, an automatic shutdown of the hoist can be achieved, as the contact forces at the sensor arm detected with the sensing rollers are cumulated without it being relevant which of the ropes is bearing what portion of the load. It is particularly advantageous if the slewing position(s) of the sensing arm can be sensed with a first, preferably two-position switch or a switch with two separate switching positions, and the slewing position of the sensor arm can be sensed with a second switch. The switch sensing the slewing position of the sensor arm serves in particular to monitor the load and the switch monitoring the slewing positions of the sensing arms serves to detect slack rope.

For safe operation of the traction sheave hoist it is furthermore of benefit if a ratchet wheel of a centrifugal trip device is attached to the traction sheave, so that in the event of excessively high rotational speeds of the traction sheave, an automatic shutdown of the motor driving the traction sheave can be effected.

The description above indicates clearly that with the traction sheave hoist according to the invention or with a service lift according to the invention, control of the adjustment devices should be effected i.a. also in relation to an external parameter. In principle, different inclinations of the platform or strain states in the load ropes can occur during operation of the service lift. Deviations from the horizontal position of the platform can be detected in a very simple manner using a measuring sensor assigned to the platform, in particular an angle sensor. In addition, the switching states of the switch for slack rope detection are available as measurement signals. The measuring signals of the angle sensor and of the slack rope detection switch can be input into an evaluation and control device that controls the adjustment devices for the hold-down systems in relation to the measuring signals. As only a limited number of different deviations for the ropes is possible, a program routine can be integrated into the evaluation and control device that executes a specific control program, depending on the respective measuring signals. In one embodiment, the measuring signal of the measuring sensor can be transmitted to the evaluation and control device in that at least one of the ropes is designed as an electric conductor for transmission of the signals.

Further advantages and embodiments of the service lift according to the invention and of the traction sheave hoist used for this purpose can be seen from the following description of an illustrative embodiment shown schematically in the drawing.

Figure 2:
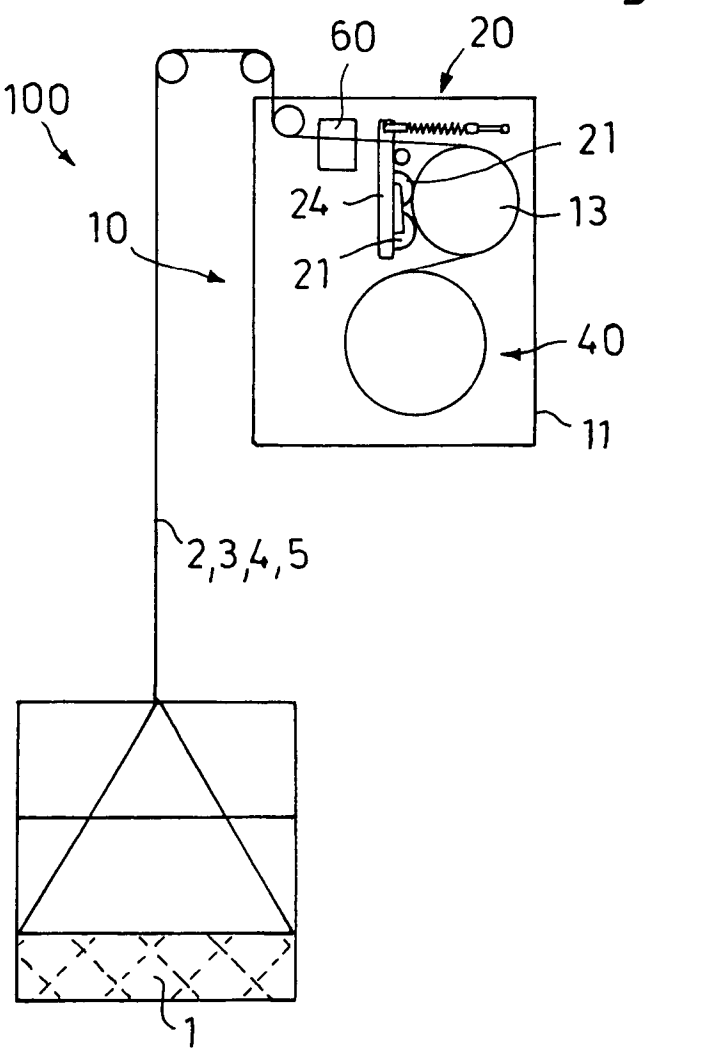
FIG. 2 shows schematically the service lift from FIG. 1 in a side view.
Figure 1:
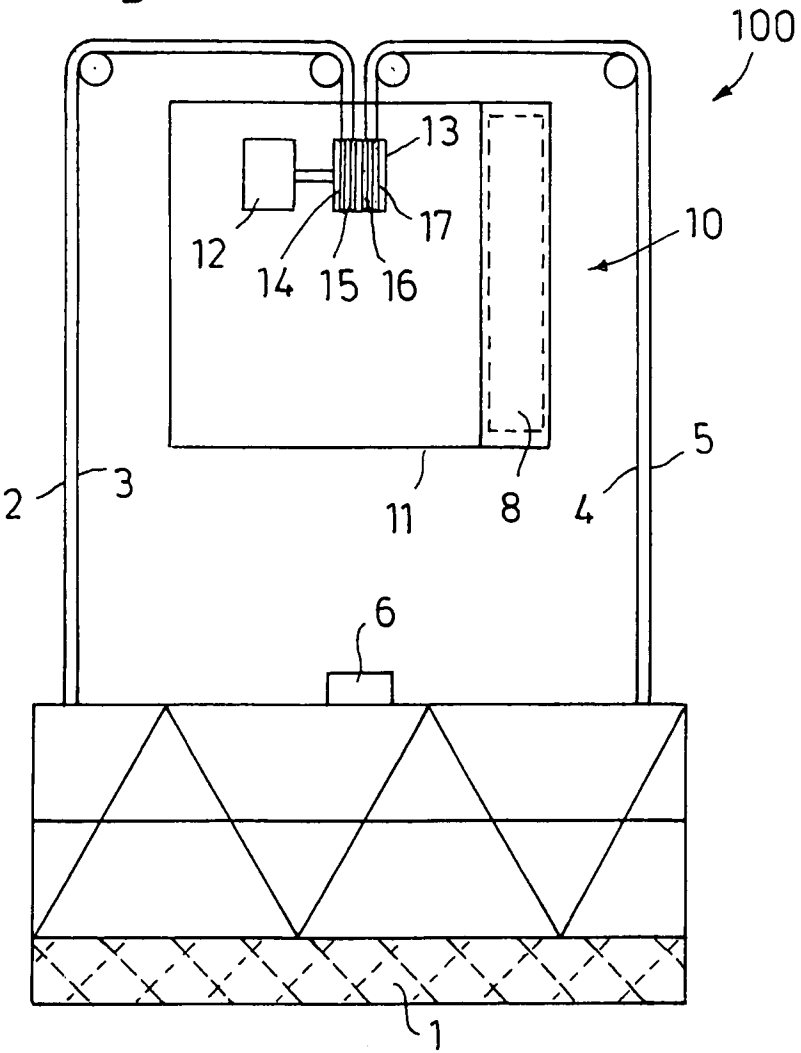
FIG. 1 shows schematically a service lift according to the invention in a front view.

In FIG. 1 and FIG. 2, reference number 100 is used to indicate a service lift according to the invention in its entirety that comprises a working platform 1 which can be moved along the facade of a building (not illustrated) with a total of four ropes 2, 3, 4, 5. A traction sheave hoist 10 comprising a traction sheave 13 with a V-shaped rope groove 14, 15, 16, 17 for each of the ropes 2, 3, 4, 5 around its circumference inside the housing 11 and driven by a motor 12 serves to raise and lower the working platform 1 via the ropes 2, 3, 4, 5. Each rope lies in its assigned rope groove and wraps around the traction sheave, partially inside its rope groove, partially outside the rope groove by a total of roughly 540°. As can be seen schematically from FIG. 2, a sensor for slack rope/overload detection referred to in its entirety with the reference number 60 and a hold-down system referred to in its entirety with the reference number 20 are assigned to each rope 2, 3, 4, 5. Furthermore, a winding device referred to in its entirety with the reference number 40 is also located in the housing 11 with which each rope is wound up inside the hoist 10. As is generally known, the individual ropes 2, 3, 4, 5 are pressed against the flanks of the V-shaped rope grooves 14, 15, 16, 17 in the traction sheave 13 by a hold-down system 20 assigned to each rope that comprises two hold-down rollers 21 mounted on a pivotable, preloaded lever 24. One rotation of the traction sheave 13 thus results during operation in a non-slip drive of the ropes 2, 3, 4, 5 wrapping around the traction sheave 13 in the rope grooves. All the ropes 2, 3, 4, 5 are wound up on a separate winding drum or round plate in the winding device 40, as will be explained below.

As can be seen particularly from the illustration in FIG. 1, the four ropes 2, 3, 4, 5 are arranged in such a way that two ropes 2, 3 are connected to one of the side ends and the other two ropes 4, 5 to the other side end of the platform 1. For safety reasons, two ropes 2, 3 and 4, 5 are prescribed at each of the side ends of the platform 1, with all the ropes 2, 3, 4, 5 in the illustrative embodiment shown forming load ropes. However, alternatively only two ropes could form load ropes while the other two ropes are safety ropes. The working platform 1 is provided with an angle sensor 6 indicated schematically which can detect inclinations of the working platform 1 relative to a horizontal orientation. The measuring signals of the angle sensor 6 can be transmitted to an evaluation and control device 8 located in or on the housing 11 of the traction sheave hoist 10. The signals can be transmitted by radio, via separately laid signal lines or preferably via one of the ropes 2-5 with one of the ropes being used, for example, as an electric conductor at the same time.

Figure 3:
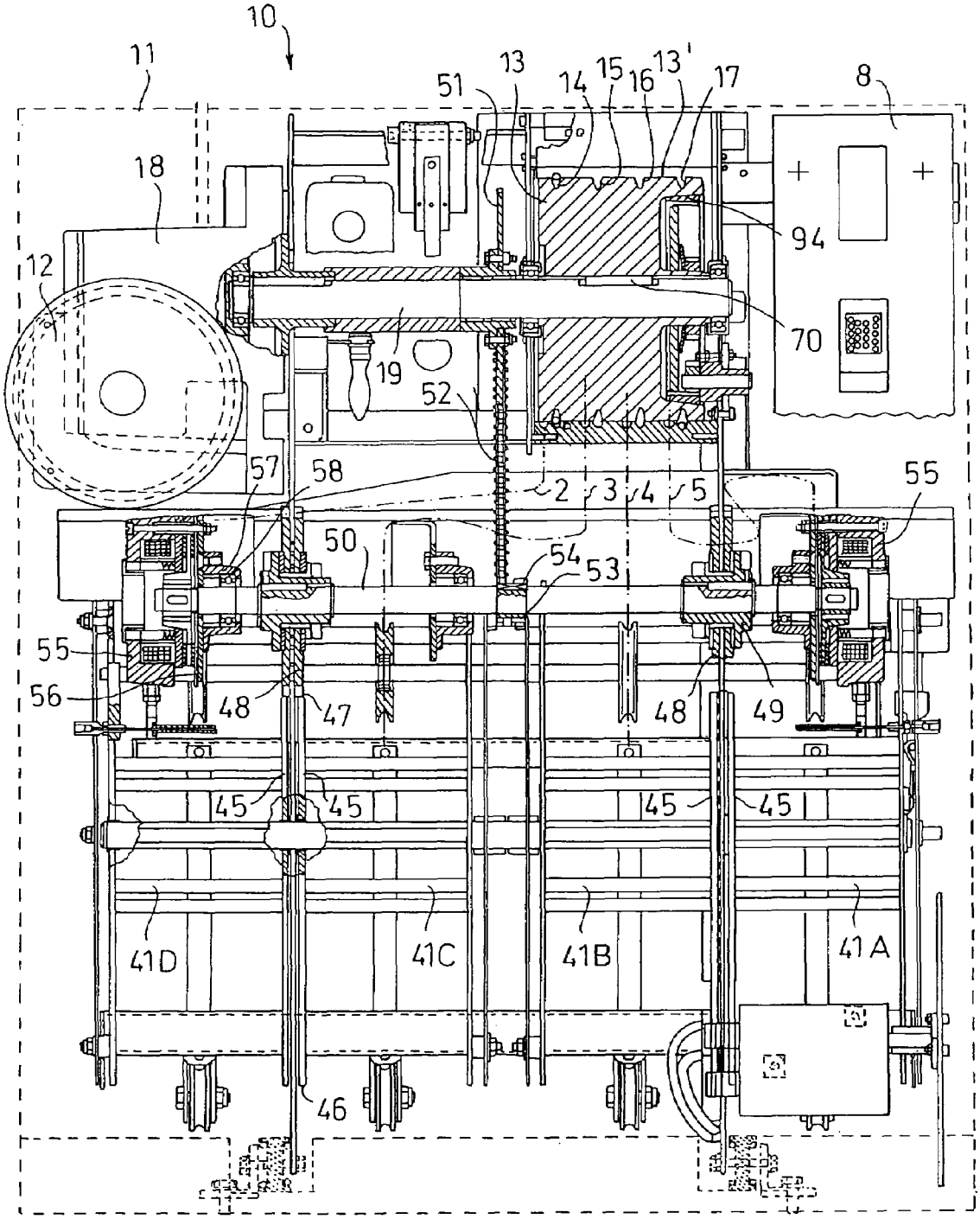
FIG. 3 shows schematically the functional parts of a traction sheave hoist according to the invention.

The overall construction of the traction sheave hoist 10 can be seen from FIG. 3. A drive shaft 19 is driven by the motor 12 via a step-down gear unit 18 and is connected rigidly to the traction sheave 13 shown in a sectional view by the parallel key 70. The four wedge-shaped or V-shaped rope grooves 14, 15, 16, 17 around the circumference 13' of the traction sheave can be clearly seen in FIG. 3. The ropes 2, 3, 4, 5 each run partially inside the rope grooves 14, 15, 16, 17 and partially outside the rope grooves immediately around the circumference 13' of the traction sheave 13. The run-off of the ropes 2, 3, 4, 5 from the traction sheave 13 axially offset from the corresponding rope groove 14, 15, 16, 17 can be easily seen from the schematic representation in the lower half of FIG. 3. Each of the ropes 2-5 is pressed into the corresponding rope groove 14-17 by a hold-down system, as is fundamentally described in DE 35 09 920 C2 of the applicant, to which express reference is made here and whose disclosure content is made the subject of the disclosure content of the present patent application by citation. A separate hold-down system 20A, 20B, 20C, 20D is provided for each rope 2-5, with all the hold-down systems being of fundamentally identical configuration. The configuration of these hold-down systems will now be explained by reference to FIG. 4.

Figure 4:
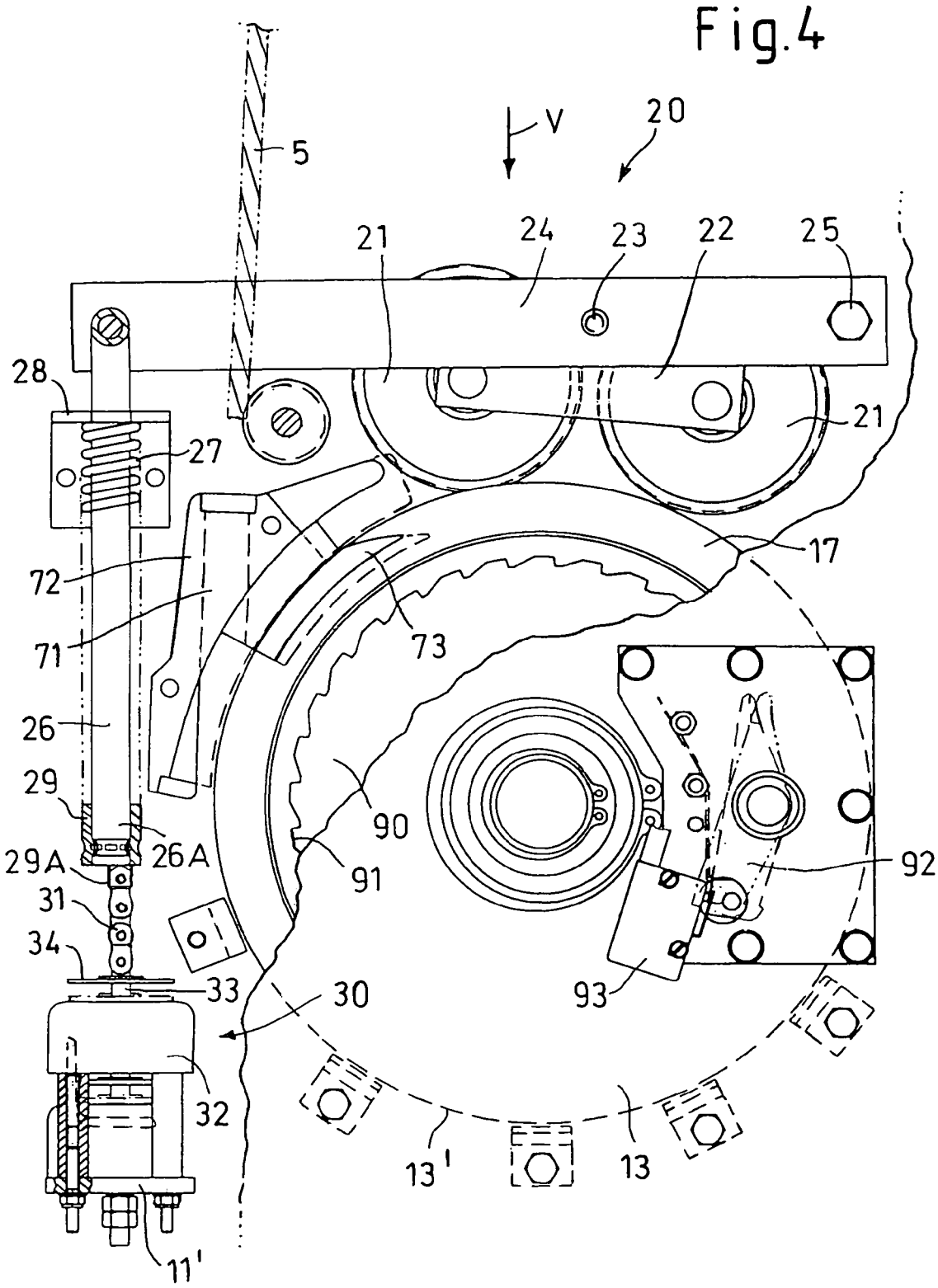
FIG. 4 shows schematically in a side view the traction sheave with hold-down system and adjustment device, partially in an exploded view.

FIG. 4 shows schematically one of the ropes, for example the rope 5 as it enters its corresponding rope groove 17 in the traction sheave 13 behind the sensor (60, FIG. 2) for slack rope and overload detection. The rope 5 is indicated with only a short section. It first passes through a bore 71 in a rope guide device 72 and then wraps around the traction sheave 13 inside the rope groove 17 by roughly 270° until it reaches the run-out tongue 73 of the rope guide device 72. The rope is lifted out of the rope groove 17 by the run-out tongue 73 and at the same time deflected axially to the side. It then lies around the outer circumference 13' of the traction sheave with a wrapping angle of a further 180. The hold-down system 20 has two rollers 21 that are pivotably mounted on a common roller support 22 that is mounted pivotably about the pivot 23 on a lever 24 that is pivotable with its right-hand end as shown in FIG. 4 about the pivot journal 25 fixed to the housing. At its other end the lever 24 is connected to a tie rod 26 that preloads the lever 24 with a preloading force in the direction of the traction sheave 13 by means of the pressure spring 27, as indicated by the arrow V in FIG. 4. The pressure spring 27 rests with its upper end against an abutment plate 28 attached to the housing of the traction sheave hoist and presses with its other end against an abutment head 29 attached to the free end 26A of the tie rod 26. During installation, the preload applied with the pressure spring 27 (arrow V) to the lever 24, and hence also to the roller pair 21 of the hold-down system 20, can be preset via the distance between the abutment plate 28 and the head 29. The rope is pressed into the rope groove 17 with the roller pair 21 of the hold-down system 20 so that it lies with a certain momentary engagement depth, i.e. with a position dependent on the geometry of the rope groove 17 and on the current diameter of the rope 5, in the rope groove 17. This engagement depth that, referred to the actual wrapping of the rope in the corresponding rope groove 17, represents in each case the radial distance between the inside of the rope 5 from the pivot axis of the traction sheave 13, influences the travel of the working platform (1, FIG. 1) effected with the rope at each revolution of the traction sheave 13, since the larger the distance is between the inside of the ropes and the pivot axis, the larger is also the travel effected with one revolution of the traction sheave 13.

According to the invention, the free end 26 A of the tie rod 26 now contacts an adjustment device referred to in its entirety with the reference number 30 that is connected via a link chain 31 to a journal 29A on the head sleeve 29 for the pressure spring 27. The adjustment device 30 comprises a schematically indicated lifting magnet 32 with which the free end 26A of the tie rod 26 in FIG. 4 can be lowered. With the lifting magnet 32 it is consequently possible, irrespective of the preload force V applied under normal circumstances with the pressure spring 27, to change and hence controllably influence the slewing position of the lever 24 and thereby the momentary position of the two rollers 21 that press against the rope in the rope groove 17. Each lifting magnet 32 is hereby controlled preferably via the control device 8 shown in FIG. 2 and FIG. 3 in relation to the measuring signals of the angle sensor (6, FIG. 1) and of the slack rope detection switch 60. Actuation of the lifting magnet 32 attached to a housing strut 11' of the housing of the traction sheave hoist results in a movement of its lifting magnet plunger and of the armature plate 24 attached to it with which the chain 31 has a pivoting connection with its other end. Only tensile forces can be transmitted from the lifting magnet 32 to the tie rod 26 by means of the chain 31. In view of the chain 31 installed between the armature plate 34 and the head sleeve 29, this stroke is transmitted to the tie rod 26 resulting in a consequent change in the position of the hold-down rollers 21. This then leads also to change in the momentary position of the rope in the rope groove 17 and hence in the effective circumference for the drive of the rope.

Figure 5:
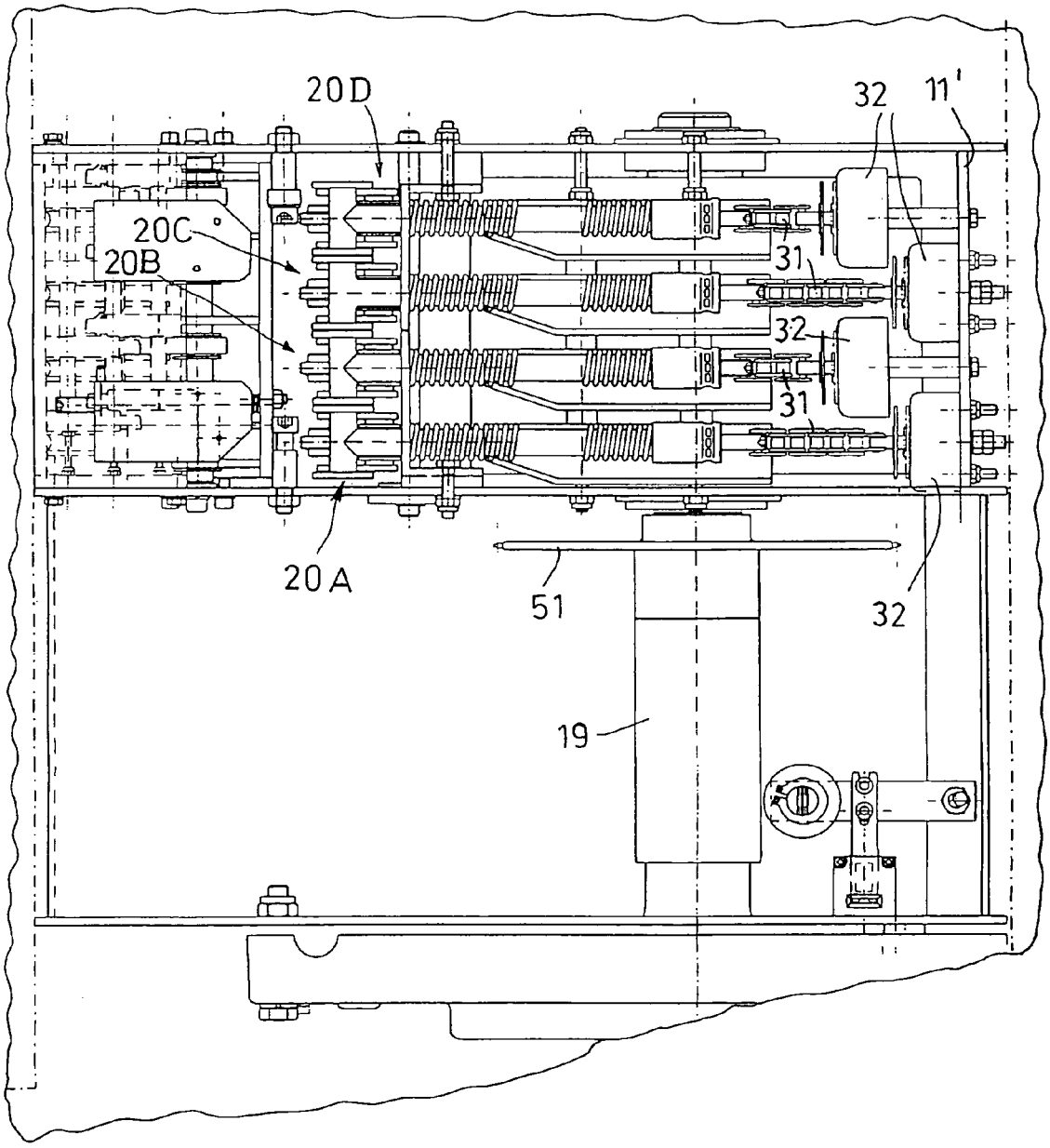
FIG. 5 shows schematically the adjustment devices arranged alongside one another on the traction sheave hoist according to FIG. 3.

Reference is now made to the illustration in FIG. 5 in which the four hold-down systems 20A, 20B, 20C, 20C for each rope are shown alongside one another. FIG. 5 shows that four tie rods 26 are provided alongside one another, whose position can be adjusted in each case by means of a separate lifting magnet 32 and associated chain 31. In order to minimise the necessary installation space, two of the lifting magnets 32 are arranged exactly alongside one another in each case, while the other two lifting magnets 32 are attached a greater distance apart to the housing strut 11' of the traction sheave hoist. In the case of lifting magnets with a different form or with a larger axial distance between the individual rope grooves, the lifting magnets can also be arranged differently. Other elements transmitting only tensile forces can also be used instead of a chain.

With the control device 8 shown in FIG. 1 it is now possible if, for example, the angle sensor 6 indicates an inclination of the platform 1, to actuate one or more of the lifting magnets 32 in order to influence the position of the corresponding hold-down system 20A, 20B, 20C, 20D and the effective engagement depth of the corresponding rope in its rope groove and to counter the inclination of the platform by changing the engagement depth. Each lifting magnet 32 can thus be actuated independently of the other lifting magnets 32 with the lifting magnets 32 preferably being actuated, however, in relation to the deviation in the position of the working platform according to an algorithm stored in the evaluation and control device 8 (control program routine). If it is discovered during operation of the service lift that one of the ropes 2-5 fundamentally has a shorter stroke than the other ropes, the corresponding lifting magnet 32 can be permanently actuated in order to change the engagement depth, effected with the corresponding hold-down system 20.

Reference is now made again to FIG. 3. The four ropes 2, 3, 4, 5 are deflected by a deflection device (not illustrated) in such a way that, while increasing the distance between them, each rope 2, 3, 4, 5 is wound onto a different winding drum 41A, 41B, 41C, 41D. Each of the winding drums 41A-41D has a drum side wall 45 that has a spur gearing around its outer circumference 46 with which the gearing 47 of a matching drive sprocket 48 meshes. Each drive sprocket 48 is connected to an output shaft 50 via a slip clutch 49. For this purpose, each of the slip clutches 49 arranged on the output shaft 50 has two clutch discs with the external gearing 47 as drive sprockets for the respective winding drums 41A-41D, with the slip clutches 49 ensuring that each rope is wound taut on the individual winding drums 41A-41D. The output shaft 50 is driven by the only motor 12. For this, a sprocket 51 with freewheel for the downward travel is mounted on the drive shaft 19 that drives a continuous drive chain 52 for the upward travel of the platform, that in turn interacts with a gear wheel 53 mounted rigidly on the output shaft 50 by means of the parallel key 54. The freewheel on the sprocket 51 ensures that the winder 40 with its winding drums 41A-41D is driven only during upward travel, i.e. in the direction of rotation for the traction sheave 13 in which the ropes 2-5 move the working platform upwards, while during the downward travel the ropes 2-5 are unwound from the winding drums 41A-41D by the weight of the platform.

Furthermore, a spring pressure brake 55 is installed on both end journals of the output shaft 50 that permits an emergency lowering of the platform in the event of a power failure or a failure of motor 12 and which can be released, for example, by means of a Bowden cable (not illustrated). The spring pressure brake comprises a stationary brake disc 56 whose supporting sleeve 57 is supported by the bearing 58 on the outer circumference of the output shaft 50, and a brake disc 59 rigidly connected to the output shaft 50. During downward travel, the unwinding speed of the ropes 2-5 from the winding drums 41A-41D can be influenced by the two spring pressure brakes 55, wherein the control can also be affected by means of the evaluation and control device 8.

Figure 6:
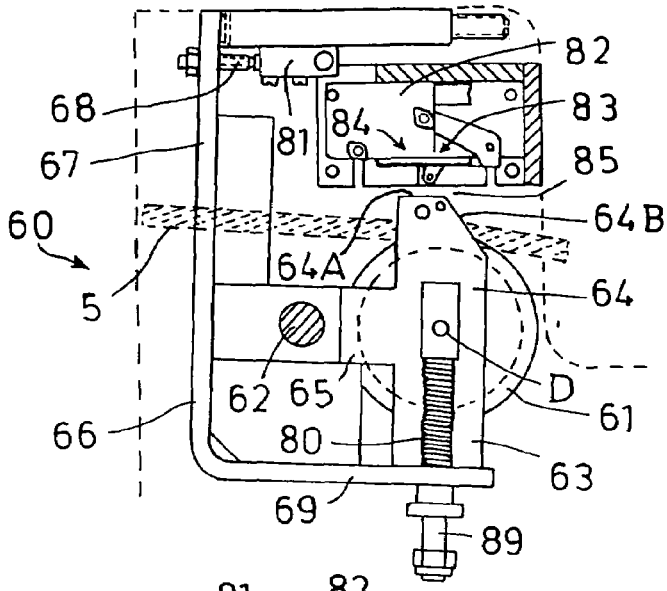
FIG. 6 shows a sensor device used on the traction sheave hoist according to FIG. 3 for the overload situation.
Figure 7:
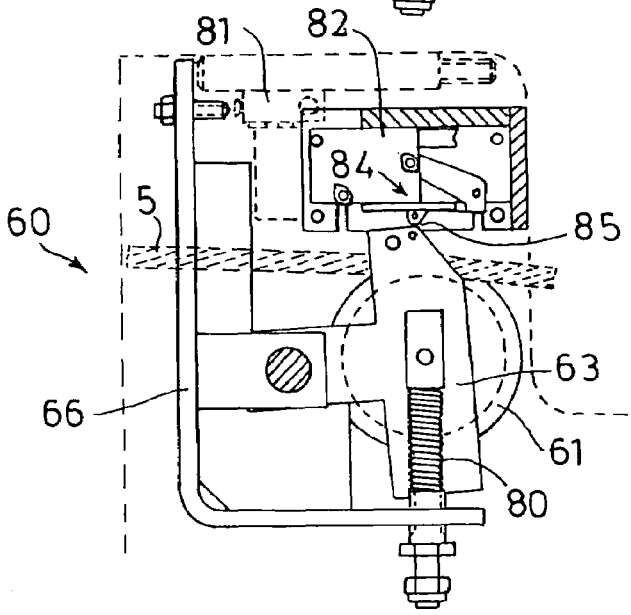
FIG. 7 shows the sensor device from FIG. 6 in switching position with a slightly slack rope.

As already explained above, a sensor device 60 for slack rope detection and/or overload detection is arranged in front of the inlet of each rope 2-5 into the traction sheave 13, whose configuration will now be described by reference to FIG. 6-8. FIG. 6 shows here the overload situation, FIG. 7 shows the sensor device 60 with a slightly slack rope and FIG. 8 the sensor 60 with an extremely slack rope, such as is the case e.g. when the working platform is lowered to the ground. The explanation is again based on the example of rope 5, although a corresponding sensor 60 is assigned to each rope 2-5. Each of the sensor devices 60 comprises a sensing roller 61 that is in contact with the corresponding rope 5 during operation of the traction sheave hoist or of the service lift. The sensing roller 61 is mounted pivotably about a pivot bearing indicated over its axis D on a sensing arm 63 that has a roughly T shape and comprises a release leg 64 and a bearing leg 65. The bearing leg 65 of the sensing arms 63 can pivot about a pivot journal 62 on the housing, depending on the tension in the rope 5. Furthermore, an L-shaped sensor arm 66 can pivot about the pivot journal 62 on the housing, wherein a shift pin 68 is supported on the long leg 67 of the sensor arm 66 and a preloading spring 80 surrounding a guide pin 89 is supported on the short leg 69 of the sensor arm 66. The preloading spring 80 presses with its other end against the pivot bearing of the sensing arm 63 in order to preload the sensing roller 61 around the pivot journal 62 against the rope 5. The shift pin 68 on the leg 67 of the sensor arm 66 acts together with an overload switch 81 and the upper face 64A of the sensing arm leg 64 together with a multi-position slack rope switch 82. An incline 64B is formed at the free face end 64A of the trip leg 64 so that both switching positions of the slack rope switch 82 can be tripped with the free face end 64A. The two switching plungers 83 and 84 for the two switching positions are shown in FIG. 6 in their respective switching position in which they are not actuated.

A slack rope switch 82 is provided on the traction sheave hoist for each of the four ropes 2-5. A single switch 81 and a single shift pin 68 is sufficient for the overload situation, as the sensor arms 66 for all four ropes 2-5 are rigidly connected. Due to the rigid connection between the four sensor arms 66, the forces transmitted by the four ropes 2-5 to the corresponding rope rollers 61 are cumulated, so that an overload situation as illustrated in FIG. 6 is always detected if an overload occurs in one of the ropes or in the addition of the forces of all the ropes. In the slewing position of the sensor arms 66 shown in FIG. 6, the switch 81 is tripped, so that the drive for the traction sheave of the traction sheave hoist is stopped.

FIG. 7 shows the switching position with a slightly slack rope. The sensor arm 66 is in a slewing position in which the switch 81 is not actuated. In view of the position of the sensor arm 66 and the tension in the preloading spring 80, the reduced tension in rope 5 compared with the normal tension (i.e. slightly slack rope) causes the sensing arm 63 with the sensing roller 61 to slew slightly in anti-clockwise direction wherein in the situation of the slightly slack rope the tripping edge 85 between the face end section 64A and the incline 64B actuates the switching plunger 83, while the switching plunger 84 is still in its starting position. The sensing switch 82 then signals the slight slack rope to the evaluation and control device (8, FIG. 3) in order to then actuate the adjustment device assigned to rope 5 by means of the algorithm stored in the device and to counter the slack rope by changing the position of the rope 5 in the corresponding rope groove of the traction sheave.

Figure 8:
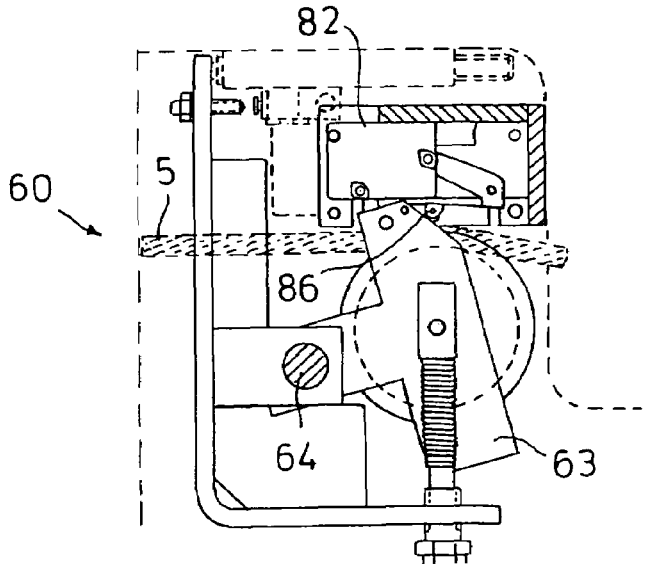
FIG. 8 shows the sensor device from FIG. 6 in switching position with an extremely slack rope.

FIG. 8 shows the switching position of the sensor 60 with an extremely slack rope. This slack rope situation occurs in particular when the working platform is lowered to the ground. Compared with the position in FIG. 7, the sensing arm 63 is slewed by a further 8° in anti-clockwise direction about the pivot journal 62. The tripping edge 85 of the sensing arm 63 now also actuates the second switching plunger 84 of the switch 82, wherein the first switching plunger 83 is also tripped by the incline 84B and by the tripping roller 86 interacting herewith. This switching position of the slack rope switch 82 is also transmitted to the evaluation and control device in order to again actuate the adjustment device for the rope 5 and/or the adjustment devices for the other ropes.

Reference is now made again to FIG. 3 and FIG. 4. A ratchet wheel 90 of a centrifugal trip device is attached to one of the face ends of the traction sheave 13 whose inner gearing 91 meshes with a ratchet 92 that actuates a switch 93 under the effects of centrifugal force and via another mechanism (not illustrated) presses a brake disc (94, FIG. 3) against the traction sheave 13 in order to stop the rotation of the traction sheave 13.

The description above will reveal numerous modifications and deviations to a person skilled in the art that should fall within the scope of the attached claims. The illustrative embodiment presented shows an extremely compact traction sheave hoist that can be easily used on a roof carriage moving along the roof. For stationary systems, larger dimensions can also be selected for the individual components of the traction sheave hoist, as space problems are then of only subordinate significance. The configuration and drive of the winder shown and the sensor for overload and slack rope detection presented and explained are of independent inventive importance and can also be used on traction sheave hoists where a single traction sheave does not have the rope grooves for all the ropes and/or no adjustment devices are provided for the individual hold-down systems.

The invention claimed is:

1. Traction sheave hoist for lifting a platform displaceable by means of at least two ropes, said traction sheave hoist comprising a motor-driven traction sheave around the circumference of which at least a first rope groove and a second rope groove are formed, and a first hold-down system for the first rope groove and a second hold-down system for the second rope groove with which the ropes wrapping around the traction sheave are pressed into the corresponding rope grooves during operation, said traction sheave hoist further comprising an adjustment device assigned to at least one of the hold-down systems with which the position or engagement depth of the rope in the rope groove achieved with the corresponding hold-down system can be controllably varied.

2. Traction sheave hoist according to claim 1, wherein an adjustment device is assigned to each of the hold-down systems with which the position or engagement depth of the corresponding rope in its rope groove can be varied in relation to the position or engagement depth of the other ropes in their rope grooves.

3. Traction sheave hoist according to claim 1, wherein the traction sheave (13) comprises a total of four rope grooves around its circumference, with all four rope grooves preferably being provided to take load-bearing ropes.

4. Traction sheave hoist according to claim 1, wherein said adjustment device can be controlled separately and/or comprises a lifting magnet as an adjustment element.

5. Traction sheave hoist according to claim 1, wherein the adjustment device is connected to the hold-down system via a connecting device transmitting only tensile forces, said connecting device comprising a chain.

6. Traction sheave hoist according to claim 1, wherein said hold-down system comprises a pivot-mounted lever on the housing to which a tie rod is linked that presses or preloads the lever against the traction sheave by means of a pressure spring.

7. Traction sheave hoist according to claim 1, wherein said hold-down system has two hold-down rollers mounted pivotably on a roller support.

8. Traction sheave hoist according to claim 6, wherein the adjustment device is arranged in series with the pressure spring and/or in series with the tie rod.

9. Traction sheave hoist according to claim 1, further comprising an evaluation and control device assigned to the adjustment device with which the adjustment device can be controllably adjusted.

10. Traction sheave hoist according to claim 1, further comprising a winding device for each rope, said winding device being driven by a motor for the traction sheave.

11. Traction sheave hoist according to claim 10, wherein the winding device for each rope has a winding drum, each provided with an external gearing, wherein a drive gear mounted on an output shaft meshes with each external gearing, via a slip clutch, wherein the output shaft is also connected to the drive shaft for the traction sheave with a freewheel in one direction of rotation and a drive in the other direction of rotation.

12. Traction sheave hoist according to claim 11, characterised in that at least one controllable braking device is assigned to the output shaft.

13. Traction sheave hoist according to claim 1, further comprising a sensor device for detection of slack rope and/or overload provided for each load rope, wherein the sensor device permits the detection of slack rope and overload at the same time.

14. Traction sheave hoist according to claim 13, wherein the sensor device comprises a sensor arm mounted pivotably about a pivot bearing and a sensing arm mounted pivotably about the pivot bearing on which a sensing roller that is in contact with the corresponding rope during operation is mounted pivotably about a pivot bearing, wherein the sensing arm is connected to the sensor arm via a preloading spring that slews the sensing arm relative to the sensor arm in relation to the contact force acting on the sensing roller.

15. Traction sheave hoist according to claim 14, wherein one of said sensor devices is provided for at least each load rope, and wherein the respective sensor arms of the sensor devices are rigidly connected to one another.

16. Traction sheave hoist according to claim 14, wherein a slewing position of the sensing arm can be sensed with a first switch and a slewing position of the sensor arm can be sensed with a second switch.

17. Traction sheave hoist according to claim 1, further comprising a ratchet wheel of a centrifugal trip device attached to the traction sheave.

18. Traction sheave hoist according to claim 1, wherein said traction sheave hoist is operably connected to a service lift comprising a platform by means of said at least two ropes.

19. Traction sheave hoist according to claim 18, further comprising an angle sensor assigned to the platform, wherein measuring signals output by the angle sensor are fed to an evaluation and control device that controls the adjustment device for the hold-down system for each rope in relation to the measuring signals.

20. Traction sheave hoist according to claim 19, wherein at least one of the ropes is an electric conductor for transmission of the measuring signals between the angle sensor and the evaluation and control device.

21. A traction sheave hoist comprising:

a motor;

a traction sheave driven by said motor and comprising a circumference in which at least a first rope groove and a second rope groove are formed, said first and second grooves adapted to receive first and second associated ropes, respectively;

a first hold-down system associated with the first rope groove for pressing the first associated rope into the first rope groove;

a second hold-down system associated with the second rope groove for pressing the second associated rope into the second rope groove;

a first adjustment device associated with the first hold-down system, said first adjustment device adapted to controllably vary a first engagement depth of the first associated rope in the first rope groove.

22. The traction sheave hoist as set forth in claim 21, further comprising:

a second adjustment device associated with the second hold-down system, said second adjustment device adapted to controllably vary a second engagement depth of the second associated rope in the second rope groove.

23. A service lift comprising:

a platform;

at least first and second ropes connected to the platform; and, a traction sheave hoist comprising for moving the platform, said traction sheave hoist comprising:

a motor;

a traction sheave driven by said motor and comprising a circumference in which at least a first rope groove and a second rope groove are formed, said first and second grooves adapted to receive said first and second associated ropes, respectively;

a first hold-down system associated with the first rope groove for pressing the first rope into the first rope groove;

a second hold-down system associated with the second rope groove for pressing the second rope into the second rope groove;

an adjustment device associated with at least one of the first and second hold-down systems for controllably varying the operating position thereof.

* * * * *